US010544715B1

(12) United States Patent
de Oliveira Ghiraldi et al.

(10) Patent No.: US 10,544,715 B1
(45) Date of Patent: Jan. 28, 2020

(54) CAM PHASER ASSEMBLY

(71) Applicant: Schaeffler Technologies AG & Co. KG, Herzogenaurach (DE)

(72) Inventors: Renato de Oliveira Ghiraldi, Madison Heights, MI (US); Alexandre Camilo, Rochester Hills, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/126,661

(22) Filed: Sep. 10, 2018

(51) Int. Cl.
*F01L 1/34* (2006.01)
*F01L 1/344* (2006.01)

(52) U.S. Cl.
CPC ... *F01L 1/3442* (2013.01); *F01L 2001/34433* (2013.01); *F01L 2001/34453* (2013.01)

(58) Field of Classification Search
CPC ..... F01L 1/3442; F01L 2001/34433; F01L 2001/34453
USPC ..... 123/90.15, 90.17
See application file for complete search history.

(56) References Cited

U.S. PATENT DOCUMENTS 7,484,486 B2 * 2/2009 Knecht ..... F01L 1/024 123/90.17
8,904,980 B2 12/2014 Hayashi et al.
2003/0196627 A1 10/2003 Lewis et al.
2006/0086332 A1 4/2006 Simpson et al.
2010/0064997 A1 3/2010 Ai
2010/0089353 A1 4/2010 Myers et al.
2011/0061616 A1 3/2011 Watanabe
2013/0312684 A1 11/2013 Boesel
2015/0013636 A1 1/2015 Boese et al.
2015/0292367 A1 10/2015 Bayrakdar et al.
2016/0010516 A1 1/2016 Suzuki et al.
2016/0169060 A1 6/2016 Fischer et al.
2018/0119581 A1 5/2018 De Oliveira Ghiraldi et al.
2018/0202328 A1 7/2018 de Oliveira Ghiraldi et al.

FOREIGN PATENT DOCUMENTS

KR 10 2009 0074161 A 7/2009

* cited by examiner

*Primary Examiner* — Ching Chang
(74) *Attorney, Agent, or Firm* — Volpe and Koenig, P.C.

(57) ABSTRACT

A cam phaser is disclosed including a stator, a rotor positioned in the stator and including a locking pin, and a locking cover including a receiving element for receiving the locking pin. A cover plate is arranged on an opposite side of the stator from the locking cover. A check valve plate is positioned between the stator and one of the locking cover or the cover plate and including a plurality of valve elements. A plurality of fastener openings are defined in each of the stator, the locking cover, and the check valve plate. Fasteners extend through the fastener openings. In one embodiment, a radial clearance is defined between the fastener openings in the check valve plate and the fasteners. In one embodiment, at least one axially extending boss is formed around at least one fastener opening of the fastener openings formed in the check valve plate.

15 Claims, 5 Drawing Sheets

CAM PHASER ASSEMBLY

FIELD OF INVENTION

The present invention relates to a cam phaser.

BACKGROUND

Cam phasers include nesting and adjacent components which must be aligned in certain relative radial positions during assembly. Proper alignment is needed, for example, to ensure an oil path is created through corresponding openings in the components. During assembly, some components, such as a check valve plate, are loosely positioned while other components are moved into place. These loose components may inadvertently move and rotate as other components are added, complicating the assembly process, rendering handling of the parts difficult, and possibly resulting in assembled devices that have misaligned parts.

Known arrangements for addressing alignment issues are disclosed in U.S. patent application Ser. Nos. 15/406,185 and 16/050,419.

The present disclosure is directed to overcoming these and other problems of the prior art.

SUMMARY

In one embodiment, a cam phaser is disclosed. The cam phaser includes a stator, a rotor positioned in the stator and including a locking pin, and a locking cover including a receiving element for receiving the locking pin. A cover plate is arranged on an opposite side of the stator from the locking cover. A check valve plate is positioned between the stator and one of the locking cover or the cover plate and including a plurality of valve elements. A plurality of fastener openings are defined in each of the stator, the locking cover, and the check valve plate. A plurality of valve elements are defined in the locking cover. A locking opening is formed in the check valve plate. A plurality of fasteners extend through the plurality of fastener openings.

In one embodiment, a radial clearance is defined between the plurality of fastener openings in the check valve plate and the plurality of fasteners.

In one embodiment, the radial clearance is 0.050 mm-0.500 mm.

In one embodiment, the check valve plate has a uniformly flat profile.

In another embodiment, at least one axially extending boss is formed around at least one fastener opening of the plurality of fastener openings formed in the check valve plate.

In one embodiment, the at least one axially extending boss includes four axially extending bosses each extending from a respective fastener opening of the plurality of fastener openings formed in the check valve plate.

In one embodiment, the axially extending boss extends axially into at least one fastener opening of the plurality of fastener openings formed in the stator.

In one embodiment, the check valve plate includes a uniform radially outer edge and a uniform radially inner edge.

In another embodiment, a method of assembling a cam phaser is disclosed. The method includes: positioning a stator, a rotor, a locking cover, and a check valve plate with respect to each other, such that: a plurality of fastener openings in the stator, the locking cover, and the check valve plate are aligned for receiving a fastener, wherein the at least one fastener opening formed in the check valve plate includes at least one axially extending boss. A plurality of fluid openings in the locking cover are aligned with a plurality of valve elements of the check valve plate. A locking opening in the check valve plate is aligned with a receiving feature in the locking cover such that a locking pin on the rotor is configured to extend through the locking opening into the receiving feature. Positioning the check valve plate with at least one of the stator or the locking cover includes at least one of: inserting at least one axially extending boss formed around the at least one fastener opening of the check valve plate into a respective fastener opening formed in the stator or the locking cover, or providing a radial clearance defined between the plurality of fastener openings in the check valve plate and the plurality of fasteners.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
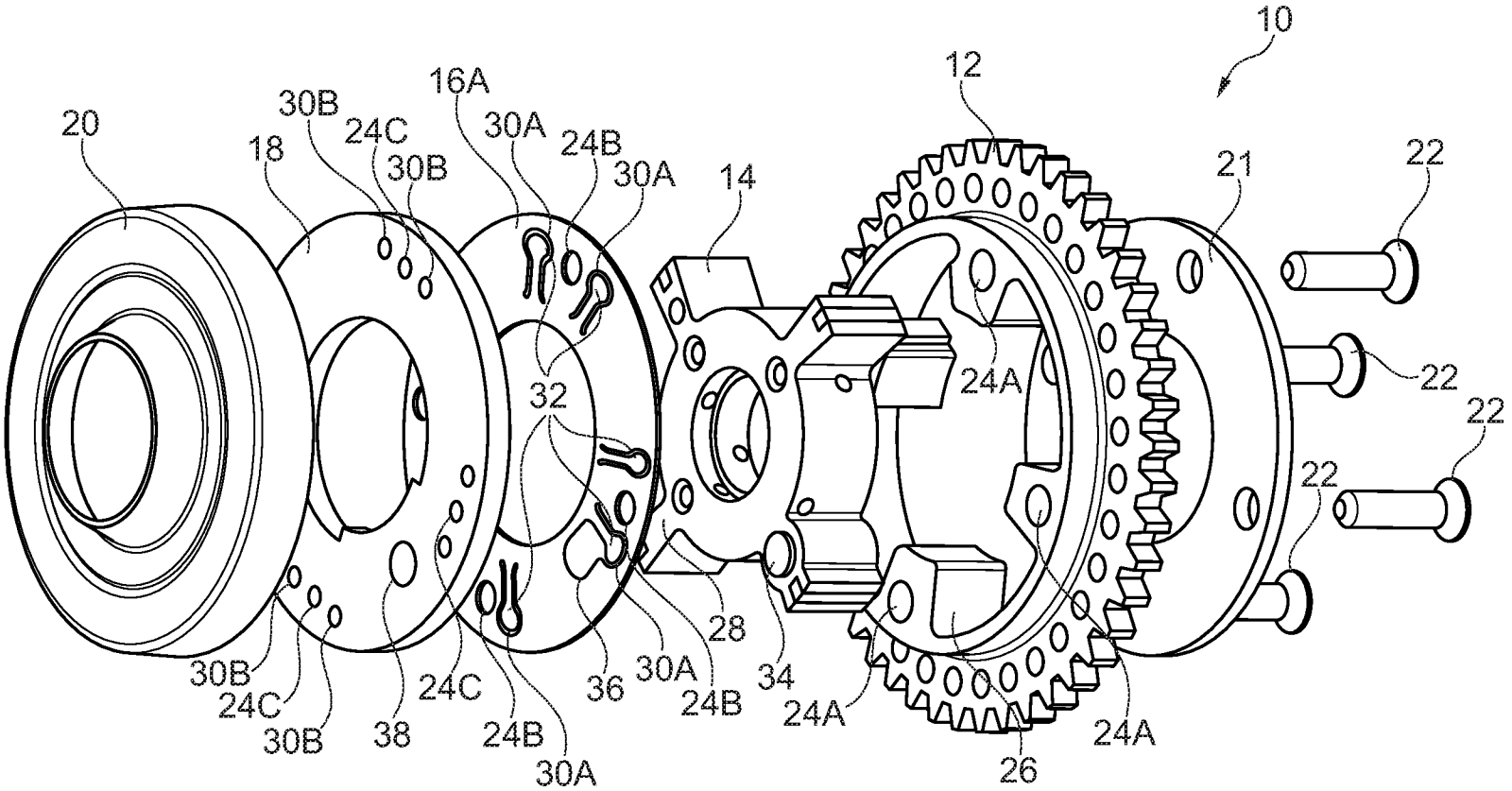
FIG. 1 is an exploded perspective view of a cam phaser assembly including a first embodiment of a check valve plate.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

FIG. 1 illustrates an exploded view of a cam phaser 10. The cam phaser 10 is preferably used in conjunction with an engine, such as an internal combustion engine, in order to vary valve timing in a manner known in the art (e.g., through hydraulic pressure). The cam phaser 10 includes at least a stator 12, a rotor 14, a check valve plate 16A, and a locking cover 18. In some embodiments, the cam phaser 10 also includes a front cover plate 20 and a rear cover plate 21. The cam phaser 10 may include additional components not described here depending on the application. For example, some configurations may include components such as a solenoid, one or more springs, a locking pin, housing parts, cam parts, a shaft, etc.

As shown in FIG. 1, the check valve plate 16A may be generally positioned between the locking cover 18 and the stator 12. The rear cover plate 21 is positioned on an opposite side of the stator 12 from the locking cover 18. In an alternative embodiment, depending on the configuration of the cam phaser 10, the check valve plate 16A may be positioned between the stator 12 and the rear cover plate 21.

In one embodiment, the cam phaser 10 further includes a plurality of fasteners 22. The plurality of fasteners 22 are preferably bolts which hold at least some of the components of the cam phaser 10 together. In one embodiment, at least the stator 12, the check valve plate 16A, and the locking cover 18 each include a plurality of fastener openings 24A, 24B, 24C, respectively, for receiving the fasteners 22. During assembly, the fastener openings 24A, 24B, 24C must be aligned in order to allow the fasteners 22 to pass through all of the components.

As shown in FIG. 1, the stator 12 includes an internal space for receiving the rotor 14. Cavities are formed between respective lobes 26 of the stator 12 and vanes 28 of the rotor 14 when the rotor 14 is positioned in the stator 12. The cam phaser 10 further includes components (e.g., fluid supply, solenoid valve, etc.) which allow a fluid to be selectively introduced into the cavities in order to rotate the rotor 14 within the stator 12, in a manner known in the art, in order to adjust the phase of a cam shaft relative to a crankshaft.

In order to introduce the fluid into the cavities, one or more axial channels are formed within the cam phaser 10. The axial channels are formed at least in part by a plurality of cutouts 30A in the check valve plate 16A and a plurality of fluid openings 30B in the locking cover 18. The cutouts 30A form a plurality of one-way valve elements 32. In an embodiment in which the check valve plate 16A is positioned between the stator 12 and the rear cover plate 21, the rear cover plate 21 may include openings which are aligned with the cutouts 30A in the check valve plate 16A.

In order to control the flow of fluid from the cavities, the one-way valve elements 32 in the cutouts 30A must be properly aligned with the openings 30B during assembly of the cam phaser 10. In addition, the check valve plate 16A must face a proper axial direction for proper alignment of the one-way valve elements 32 if the same valve plate 16A is to be used as a universal part for different cam phasers, such as an intake phaser or an exhaust phaser.

The cam phaser 10 further includes a locking pin 34 positioned in a vane 28 of the rotor 14. The locking pin 34 selectively locks the rotor 14 to the locking cover 18 to fix the rotor 14 relative to the stator 12. For example, the locking pin 34 is forced by a spring through a locking opening 36 in the check valve plate 16A and into a receiving feature 38 in the locking cover 18. In order to allow proper functioning of the locking pin 34, the check valve plate 16A and the locking cover 18 must be aligned during assembly such that the locking opening 36 and the receiving feature 38 are aligned with each other.

The receiving feature 38 may be any integral or separate component part of the locking cover 18 which is configured to receive an end of the locking pin 34. For example, the receiving feature 38 may be a bushing which is inserted in an opening, bore, or aperture in a body of the locking cover 18. The bushing may be cylindrical, cup-shaped, open-ended, etc. In another example, the receiving feature 38 may be a fine-blanked hole formed in the body of the locking cover 18 or an indentation. The hole may be heat-treated to attain a hardness suitable for receiving the locking pin 34. In yet another example the receiving feature 38 may be a hardened insert placed in a receiving aperture formed within the locking cover 18 to serve as a reception area for the locking pin 34.

Proper assembly of the cam phaser 10 requires alignment of the fastener openings 24A, 24B, 24C, the plurality of cutouts 30A and valve elements 32 with the plurality of fluid openings 30B, and the locking opening 36 and receiving feature 38. During an assembly process, especially a manual assembly process, it may be difficult to keep all of the components of the cam phaser 10 in their proper relative positions and install the fasteners 22.

Figure 2A:
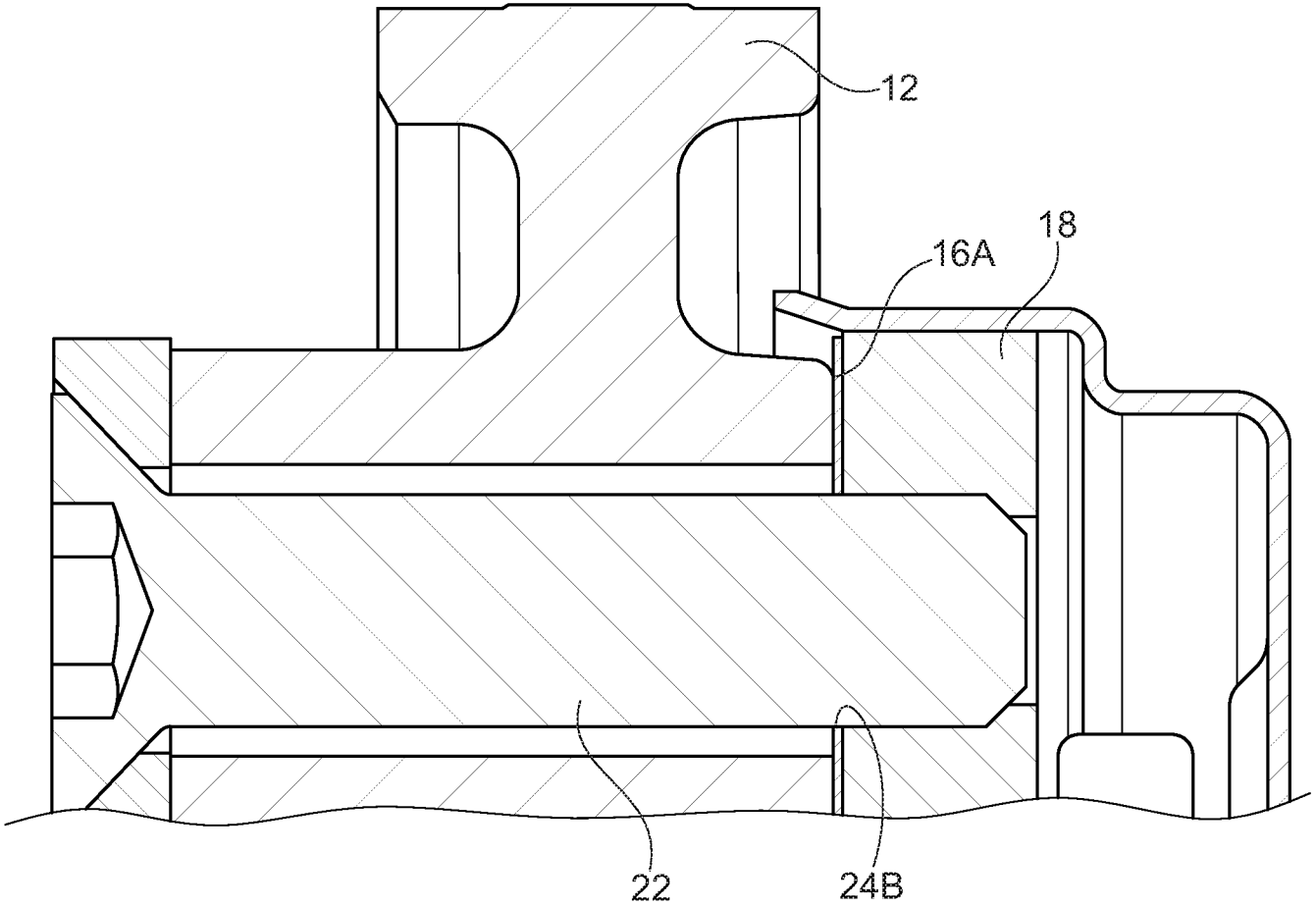
FIG. 2A is a magnified cross-section view of a portion of the cam phaser assembly of FIG. 1.
Figure 2B:
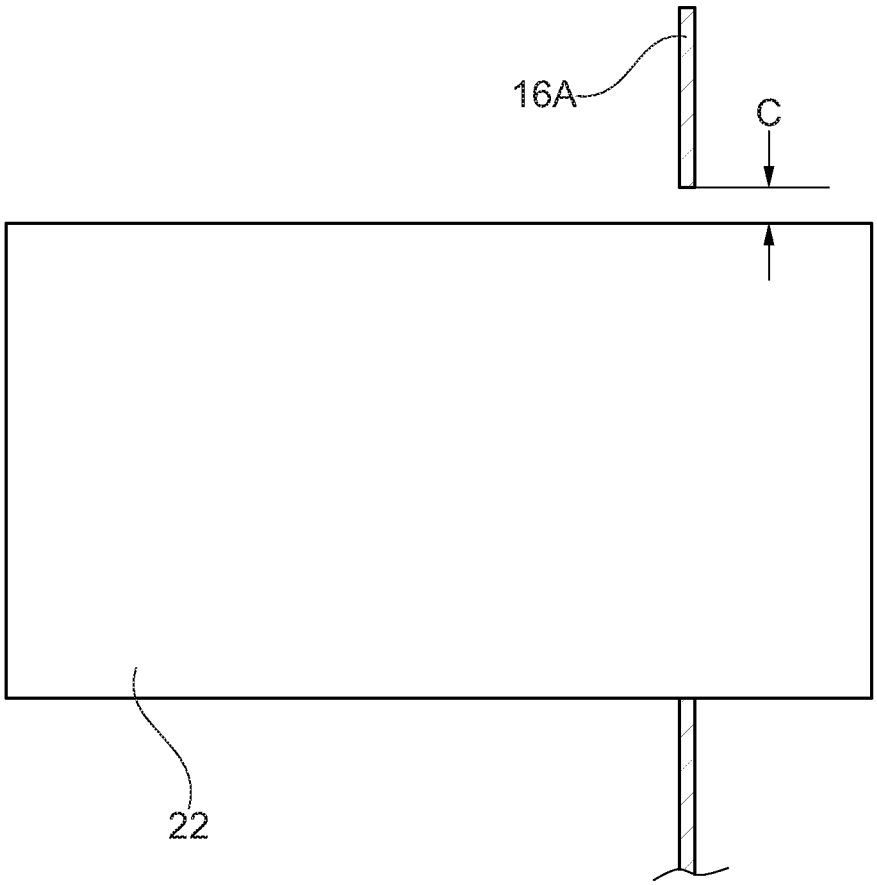
FIG. 2B is a magnified view of a radial clearance between a fastener and a check valve plate of FIGS. 1 and 2A.

In the embodiment of FIGS. 1, 2A, and 2B, in order to ensure proper alignment during assembly, the check valve plate 16A provides a radial clearance between the plurality of fastener openings 24B in the check valve plate 16A and the plurality of fasteners 22. FIG. 2B more clearly illustrates the radial clearance C is 0.050 mm-0.500 mm. In one embodiment, the radial clearance C is 0.25 mm+/−0.10 mm. In one embodiment, the radial clearance C is at least 0.050 mm. In one embodiment, the radial clearance C is 0.275 mm.

In one embodiment, the check valve plate 16A has a thickness of 0.25 mm+/−0.05 mm. In one embodiment, the thickness of the check valve plate 16A is 500% of the radial clearance C. In one embodiment, the thickness of the check valve plate 16A is 50% of the radial clearance C.

The relatively tight radial clearance with the fasteners 22 ensures that the locking cover 18 and the check valve plate 16A are aligned during assembly/backlash adjustment.

As shown in FIGS. 1 and 2A, the check valve plate 16A has a uniformly flat profile. The profile of the check valve plate 16A is a completely flat ring, which lacks any axial protrusion or features.

Figure 3:
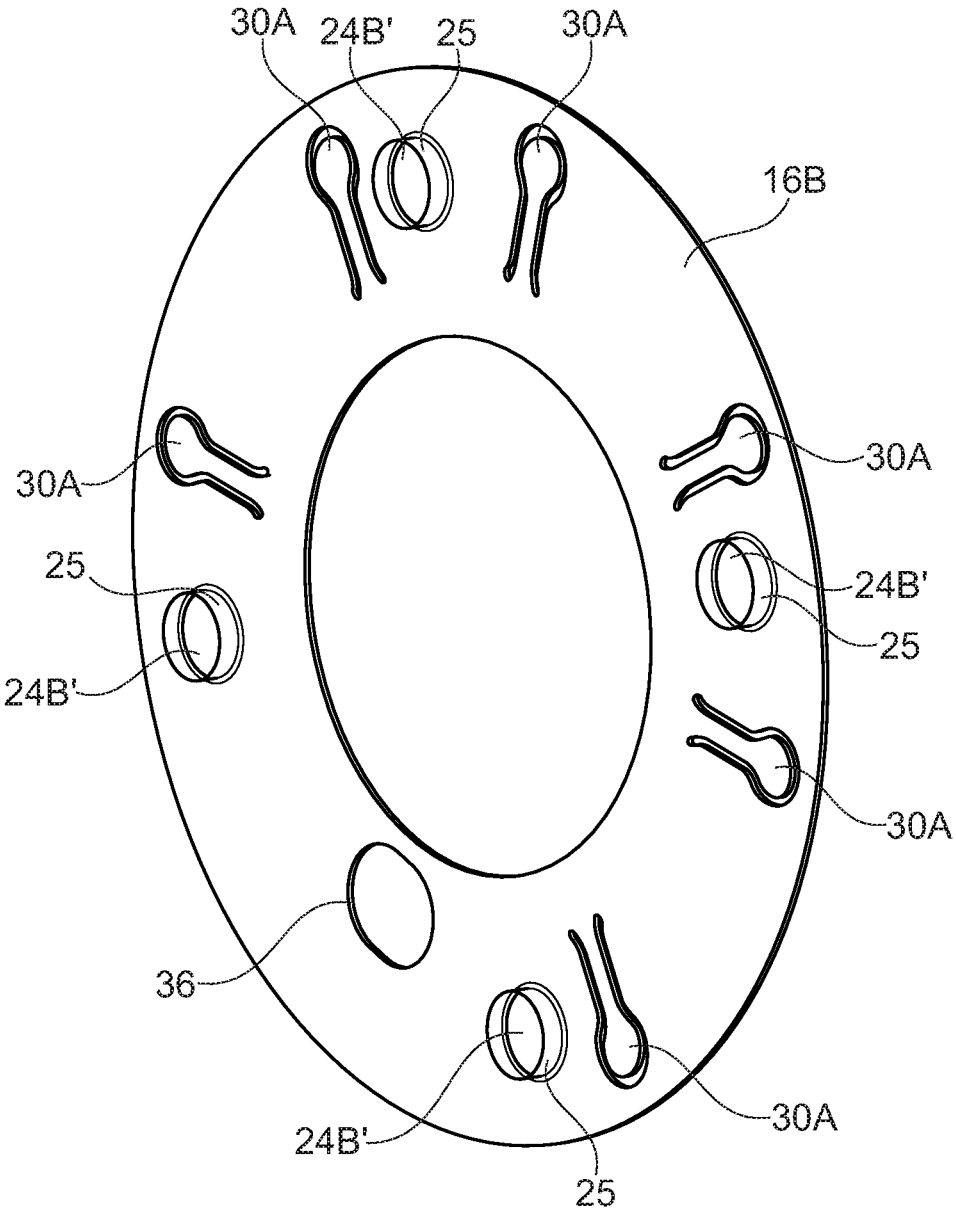
FIG. 3 is a perspective view of a second embodiment of a check valve plate.
Figure 4:
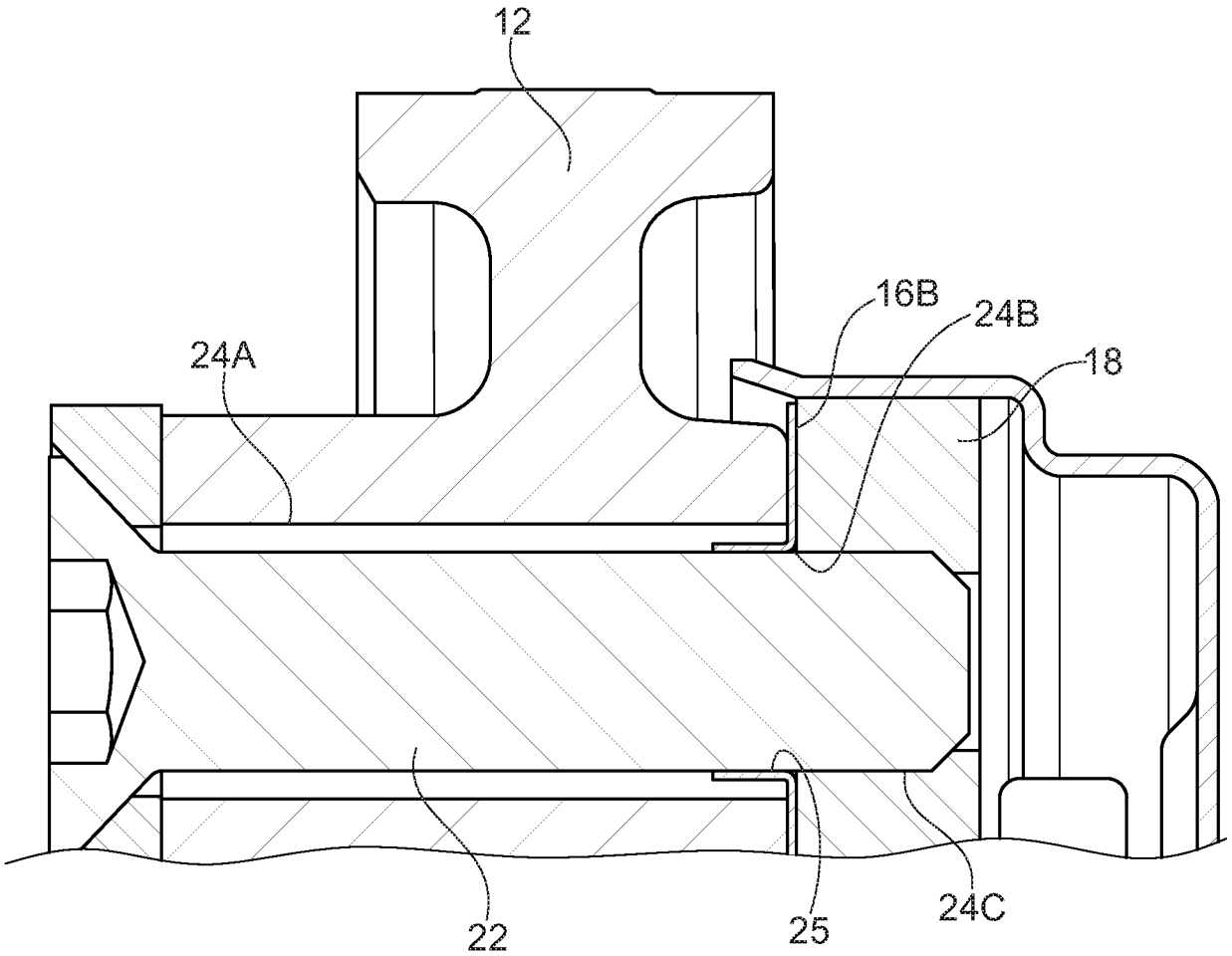
FIG. 4 is a magnified cross-section view of a portion of the check valve plate of FIG. 3 installed in a cam phaser assembly.

In one embodiment shown in FIGS. 3 and 4, in order to ensure proper alignment during assembly, at least one axially extending boss 25 is formed around at least one fastener opening 24B' formed in the check valve plate 16B.

As shown in the drawings, the axially extending boss 25 extends exclusively in the axial direction.

As shown in FIG. 3, the at least one axially extending boss 25 can include four axially extending bosses 25 each extending from a respective fastener opening 24B' in the check valve plate 16B. One of ordinary skill in the art would understand that the axially extending boss 25 can be formed around any number of the fastener openings 24B'.

In one embodiment, the axially extending boss 25 has an axial extension of at least 0.020 mm. In one embodiment, the axially extending boss 25 has an axial extension of 2.00 mm.

As shown in FIG. 4, the at least one axially extending boss 25 extends axially into a fastener opening 24A in the stator 12. One of ordinary skill in the art would understand that the axially extending boss 25 could extend in an opposite axial direction and into the fastener opening 24C of the locking cover 18.

The check valve plates 16A, 16B can include a uniform radially outer edge and a uniform radially inner edge. The radially inner edge and radially outer edge lack protrusions. The radially inner edge and radially outer edge each have a smooth, continuously curved profile.

The at least one axially extending boss 25 is inserted into the stator 12 such that the check valve plate 16B and the stator 12 are connected to each other and held in a proper angular position while the remainder of the components are moved into position.

In another embodiment, the check valve plate 16A, 16B may be connected to either the stator 12 or the locking cover 18 (or the rear cover plate 21), thereby inhibiting inadvertent rotation of the check valve plate 16A, 16B during an assembly process.

During an assembly process, the rotor 14 is positioned in the stator 12, the check valve plate 16 and the locking cover 18 are positioned over the rotor 14, the front and rear cover plates 20, 21 are moved into place, and the fasteners 22 are inserted through the aligned fastener openings 24A, 24B, 24C.

The plurality of fastener openings 24A, 24B, 24C in the stator 12, locking cover 18, and check valve plate 16 are aligned for receiving a fastener 22, the plurality of fluid openings 30B are aligned with the valve elements 32 for forming at least a portion of a pressure-controlled fluid channel, and the locking opening 36 in the check valve plate 16 is aligned with the receiving feature 38 in the locking cover 18 such that the locking pin 34 on the rotor 14 is configured to extend through the locking opening 36 into the receiving feature 38.

Consistent with the disclosed embodiments, the radial clearance C or the axial boss 25, simplifies an assembly process of the cam phaser 10. The radial clearance C or the axial boss 25 allows the check valve plate 16 to be connected to an adjacent component (i.e. the stator 12 or the locking cover 18) in an angular position which aligns the fastener openings 24B of the check valve plate 16 with either the fastener openings 24A of the stator 12 or the fastener openings 24C of the locking cover 18. The check valve plate 16 is inhibited from rotating to an unaligned positioned while other assembly steps are performed, thus providing a more efficient and effective assembly process of cam phaser 10.

PARTS LIST

10. Cam Phaser
12. Stator
14. Rotor
16A, 16B. Check Valve Plate
18. Locking Cover
20. Front Cover Plate
21. Rear Cover Plate
22. Fastener
24A. Fastener Opening
24B. Fastener Opening
24C. Fastener Opening
25. Axial Boss
26. Lobe
28. Vane
30A. Cutout
30B. Fluid Opening
32. Valve Element
34. Locking Pin
36. Locking Opening
38. Receiving Feature *

What is claimed is:

1. A cam phaser comprising:
a stator;
a rotor positioned in the stator and including a locking pin;
a locking cover including a receiving element for receiving the locking pin;
a cover plate on an opposite side of the stator from the locking cover;
a check valve plate positioned between the stator and one of the locking cover or the cover plate and including a plurality of valve elements;
a plurality of fastener openings in each of the stator, the locking cover, and the check valve plate;
a plurality of fluid openings in the locking cover;
a locking opening formed in the check valve plate; and
at least one axially extending boss formed around at least one fastener opening of the plurality of fastener openings formed in the check valve plate.

2. The cam phaser of claim 1, wherein the at least one axially extending boss includes four axially extending bosses each extending from a respective fastener opening of the plurality of fastener openings formed in the check valve plate.

3. The cam phaser of claim 1, wherein the axially extending boss extends axially into at least one fastener opening of the plurality of fastener openings formed in the stator.

4. The cam phaser of claim 1, wherein the check valve plate includes a uniform radially outer edge and a uniform radially inner edge.

5. The cam phaser of claim 1, wherein the axially extending boss has an axial extension of 0.020 mm-2.00 mm.

6. A cam phaser comprising:
a stator;
a rotor positioned in the stator and including a locking pin;
a locking cover including a receiving element for receiving the locking pin;
a cover plate on an opposite side of the stator from the locking cover;
a check valve plate positioned between the stator and one of the locking cover or the cover plate and including a plurality of valve elements;
a plurality of fastener openings in each of the stator, the locking cover, and the check valve plate;
a plurality of fluid openings in the locking cover;
a locking opening formed in the check valve plate;
a plurality of fasteners extending through the plurality of fastener openings; and
a radial clearance defined between the plurality of fastener openings in the check valve plate and the plurality of fasteners.

7. The cam phaser of claim 6, wherein the radial clearance is 0.050 mm-0.500 mm.

8. The cam phaser of claim 6, wherein the radial clearance is 0.25 mm+/−0.10 mm.

9. The cam phaser of claim 6, wherein the check valve plate has a uniformly flat profile.

10. The cam phaser of claim 6, wherein the check valve plate includes a uniformly curved radially outer edge and a uniformly curved radially inner edge.

11. The cam phaser of claim 6, wherein the check valve plate has a thickness, and the thickness is 50%-500% of the radial clearance.

12. A method of assembling a cam phaser, the method comprising:
positioning a stator, a rotor, a locking cover, and a check valve plate with respect to each other, such that:
a plurality of fastener openings in the stator, the locking cover, and the check valve plate are aligned for receiving a fastener;
a plurality of fluid openings in the locking cover are aligned with a plurality of valve elements of the check valve plate;
a locking opening in the check valve plate is aligned with a receiving feature in the locking cover such that a locking pin on the rotor is configured to extend through the locking opening into the receiving feature,
wherein positioning the check valve plate with at least one of the stator or the locking cover includes at least one of:
(i) inserting at least one axially extending boss formed around the plurality of fastener openings of the check valve plate into a respective fastener opening formed in the stator or the locking cover, or (ii) providing a radial clearance defined between the plurality of fastener openings in the check valve plate and the plurality of fasteners.

13. The method of claim 12, wherein the at least one axially extending boss includes four axially extending bosses each extending from a respective fastener opening of the plurality of fastener openings formed in the check valve plate.

14. The method of claim 12, wherein the axially extending boss extends axially into at least one fastener opening of the plurality of fastener openings formed in the stator.

15. The method of claim 12, wherein the check valve plate includes a uniform radially outer edge and a uniform radially inner edge.

* * * * *